US006000626A

United States Patent [19]

Futo et al.

[11] Patent Number: 6,000,626

[45] Date of Patent: Dec. 14, 1999

[54] HAND OPERATED WATER SPRAYER AND SOAP DISPENSER

[75] Inventors: Dennis M. Futo, Strongsville; Erin Q. Riddell; Jesse P. Carlson, both of Cleveland, all of Ohio

[73] Assignee: Waxman Consumer Products Group, Inc., Bedford Heights, Ohio

[21] Appl. No.: 09/005,570

[22] Filed: Jan. 12, 1998

[51] Int. Cl.[6] ..... A45D 19/02

[52] U.S. Cl. ..... 239/74; 239/333; 239/526

[58] Field of Search ..... 239/10, 310, 525, 239/526, 530, 289, 329, 71, 588, 333, 549, 556, 558, 562, 74; 222/383

[56] References Cited

U.S. PATENT DOCUMENTS

| | | | |
|---|---|---|---|
| 670,234 | 3/1901 | Hughen . | |
| 1,191,578 | 7/1916 | Englund . | |
| 1,476,090 | 12/1923 | Lipsner et al. . | |
| 1,510,062 | 9/1924 | Kenney | 239/525 |
| 1,532,809 | 4/1925 | Girard . | |
| 1,579,869 | 4/1926 | Klages . | |
| 1,745,323 | 1/1930 | Coe et al. | 239/530 |
| 1,760,018 | 5/1930 | Soss . | |
| 2,028,042 | 1/1936 | Braunstein . | |
| 2,094,161 | 9/1937 | Paddock | 239/289 |
| 2,250,878 | 7/1941 | Quaranti . | |
| 2,301,691 | 11/1942 | Ellinger et al. . | |
| 2,540,064 | 1/1951 | Weber . | |
| 2,584,631 | 2/1952 | Soss . | |
| 2,590,353 | 3/1952 | Schaar et al. . | |
| 2,602,698 | 7/1952 | Wyckoff . | |
| 2,616,660 | 11/1952 | Morehouse . | |
| 2,619,385 | 11/1952 | Simms . | |
| 2,639,445 | 5/1953 | Rowlett | 239/526 |
| 2,690,930 | 10/1954 | Corson . | |
| 2,795,460 | 6/1957 | Bletcher et al. | 239/530 |
| 3,207,444 | 9/1965 | Kelley et al. . | |
| 3,259,321 | 7/1966 | Sellers . | |
| 3,271,809 | 9/1966 | Morawski . | |
| 3,361,300 | 1/1968 | Kaplan | 239/526 |
| 3,402,892 | 9/1968 | Ayrial et al. . | |
| 3,486,695 | 12/1969 | Novak . | |
| 3,581,998 | 6/1971 | Roche . | |
| 3,917,172 | 11/1975 | O'Hare . | |
| 4,027,984 | 6/1977 | Underwood . | |
| 4,211,368 | 7/1980 | Legros et al. . | |
| 4,228,558 | 10/1980 | Zhadanov . | |
| 4,236,840 | 12/1980 | Kennedy . | |
| 4,330,088 | 5/1982 | Koyama et al. . | |
| 4,374,444 | 2/1983 | Zhadanov . | |
| 4,840,311 | 6/1989 | Shamblin | 239/74 |
| 4,854,505 | 8/1989 | LaVine, Jr. . | |
| 4,895,468 | 1/1990 | Chappell . | |
| 5,100,055 | 3/1992 | Rokitenetz, et al. | 239/525 |
| 5,109,553 | 5/1992 | Kishimoto . | |
| 5,305,476 | 4/1994 | Ohyama et al. . | |
| 5,619,766 | 4/1997 | Zhadanov et al. . | |
| 5,906,319 | 3/1997 | Crowl . | |

*Primary Examiner*—Kevin Weldon
*Attorney, Agent, or Firm*—Vickers, Daniels & Young

[57] ABSTRACT

A hand held water sprayer for connection to a source of water under pressure by a flexible hose has a manually displaceable trigger actuator on the front of the sprayer housing for controlling the flow of water therethrough from the source and includes a soap reservoir in the sprayer housing and a push button soap pump actuator on the rear of the sprayer housing for dispensing a quantity of soap from the reservoir to the outlet end of the sprayer. A cleaning attachment is adapted to be removably mounted on the outlet end to facilitate the cleaning of an article in connection with the dispensing of soap and the spraying of water thereonto.

54 Claims, 6 Drawing Sheets

206
12
18
10
20
22
16
14
212
206
22
208
210
186
30
184
88
68
68a
68a
90
74
144
18
76
78a
78
146
32
34
86
86a
82
92
80
24
84
36
70
72
72a
24
16
42
28
140
138
142
152
148
150
156
160
172
164
132
20
44
146
150
48

HAND OPERATED WATER SPRAYER AND SOAP DISPENSER

BACKGROUND OF THE INVENTION

This invention relates to the art of hand operated sprayers and, more particularly, to a hand operated sprayer having a soap dispensing capability.

The present invention finds particular utility in connection with a hand operated water sprayer of the character associated with a sink such as a kitchen sink to facilitate rinsing the sink, dishes, glasses, eating utensils, and the like and, accordingly, will be described in detail herein in conjunction with such an environment of use. At the same time, however, it will be appreciated that the sprayer in accordance with the present invention has utility in other environments and in connection with cleaning and/or rinsing objects or articles other than those associated with a kitchen environment.

Hand operated kitchen sink sprayers are of course well known and, generally, include a hand held housing of metal or plastic having a water inlet end attached to a source of water under pressure by a flexible hose and having an outlet end for discharging water in the form of a spray. A water flow control valve arrangement in the housing is operable through a finger or thumb operated actuator outside the housing to selectively enable or disable the flow of water through the sprayer and, generally, the sprayer is supported in a storage position in an opening therefore in the sink and through which the flexible hose is adapted to be extended and retracted to facilitate displacing the sprayer from the storage to a use position and then back to the storage position.

Sprayers of the foregoing character are used in conjunction with rinsing dishes, glasses, eating utensils and the like after the latter have been washed with soap, thus to remove the soap prior to drying the articles. Such sprayers are also used in a similar manner to pre-clean foods from the articles prior to introducing the articles into a dishwashing machine. Such pre-cleaning may also involve the use of soap to remove dried or hardened food such as egg yolks which, otherwise, may not be removed from plates and utensils by washing in a dishwashing machine. Such pre-washing using soap has heretofore required filling the sink or other container with a quantity of water, adding soap to the water from a bottle or other container, washing an article through the use of a brush, sponge and/or cloth and then withdrawing the sprayer from its storage position to rinse the article. Alternatively, in connection with pre-cleaning of articles which are placed in a dishwasher for a subsequent washing operation, loose food particles are removed from the articles through the use of a brush, sponge or the like and, in connection therewith, the article is often held under the sink faucet with the water running which is extremely wasteful with respect to the use of water. If the hand operated sprayer is used in connection with such pre-cleaning, the person doing the cleaning is inconvenienced by having to hold the article in one hand while manipulating the brush or sponge with the other and then laying the latter down and pulling the sprayer from its storage position to rinse the article. Further inconvenience is encountered if an article requires the use of soap which has to be dispensed onto the article or onto the brush or sponge from its container which then has to be put down so that the article can be held in one hand and the brush or sponge in the other to facilitate cleaning the article. After such cleaning, the brush or sponge has to be put down so that the sprayer can be withdrawn from its storage position and operated to rinse the article. Accordingly, it will be appreciated that considerable time and energy as well as water is wasted in performing the washing and/or pre-washing of dishes and other utensils in the foregoing manner and that neither such washing or pre-washing operation is efficient with respect to optimizing the ease of and minimizing the number of hand motions and manipulations required on the part of the person performing the washing or pre-washing operation.

It has been proposed heretofore, as shown for example in the shower and shampoo brushes disclosed in patents 1,191,578 to England, 1,760,018 to Soss, 2,250,878 to Quaranti, 4,236,840 to Kennedy and 5,109,553 to Kishimoto to provide a spraying device with the ability to selectively discharge water or soap therefrom. While such devices would have the capability of alleviating certain of the user inconveniences referred to above in connection with their use as a sink mounted sprayer, the soap and water dispensing controls are inconvenient and/or impossible to operate either simultaneously or by just one hand of the user, whereby a user attempting to clean an article may have to put the article down in order to manipulate one or the other of the controls. Accordingly, the washing and/or rinsing operation is encumbered and, in connecting with manipulating one or the other of the controls, the user's attention may be detracted from the direction of dispensing of the water or soap, whereby the latter is misdirected onto adjacent surface areas which have to be wiped dry. Moreover, the operation becomes inefficient from the standpoint of both time and potential wastage of water and/or soap. Further, in most of the water and soap dispensing devices heretofore available, the dispensing of soap is by gravity flow and, accordingly, is slow. Furthermore, unless the water flow is shut off during the dispensing of soap, the water under pressure can flow into the soap reservoir thus diluting the soap and possibly causing the latter to suds in the reservoir, both of which are undesirable. Even in the shampoo brush in the patent to Kishirnoto, wherein soap is pushed through the dispensing outlet, the chamber from which the soap is dispensed is filled by gravity and there is a period of time during dispensing when both the chamber and soap reservoir are open to the backflow of water thereinto which, as pointed out above, can either dilute the soap or cause sudsing thereof None of the sprayers heretofore available provide for selectively or simultaneously dispensing water and soap in a manner which is efficient with respect to operation of the sprayer and convenient with respect to manipulation of the water and soap dispensing control devices by the user.

SUMMARY OF THE INVENTION

In accordance with the present invention, a hand operated sprayer is provided which advantageously minimizes or overcomes the foregoing disadvantages of such sprayers heretofore available. More particularly in this respect, a sprayer in accordance with the present invention enables the performing of a cleaning and rinsing operation in a manner which is more efficient and economic than heretofore possible with respect to the consumption of time and energy on the part of the operator and with respect to the consumption of water and soap. Further, a sprayer in accordance with the invention advantageously minimizes the number of movements and manipulations required with respect to the hands and fingers of the user during a cleaning operation In accordance with one aspect of the invention, a sprayer is selectively operable to dispense soap or to spray water from the outlet end thereof, or to dispense both simultaneously, and enables the operator to do either or both with one hand and with minimal manipulation of the fingers of the one hand. Accordingly, the operator can wet and apply soap to an article more quickly and more efficiently than heretofore possible. Preferably, the outlet end of the sprayer is provided with an attachment such as a brush, whereby an article to be cleaned can be held in one hand and cleaned and rinsed following the wetting and applying of soap thereto and without having to put the article down in order to manipulate the sprayer dispensing control components. In particular in this respect, the water and soap dispensing actuators are preferably on opposite sides of the handle of the sprayer and located for manipulation by the fingers and thumb of one hand of the user, whereby manipulation thereof can be achieved either selectively or simultaneously. The soap is positively displaced in the sprayer, thus to minimize the dispensing time with respect thereto.

In accordance with another aspect of the invention, the soap is dispensed from the sprayer by a positive displacement pump, and the soap outlet includes a check valve arrangement which positively precludes the backflow of water into the pump even in the event of simultaneous water and soap dispensing. This advantageously maintains the desired consistency of the soap in the reservoir and pump and precludes any undesirable diluting and/or sudsing thereof in the latter areas.

In accordance with a further aspect of the invention, the sprayer includes a housing having a head and a handle and water valve and soap pump assemblies structured and located in the head in a manner which minimizes the space requirements therefor and thus the overall dimensions of the sprayer housing. Preferably, the pump and valve assemblies have corresponding actuators which are linearly displaceable along corresponding and parallel axes extending in the direction between the front and rear ends of the head of the sprayer, whereby the lateral dimensions of the head portion of the sprayer housing are minimized. This arrangement advantageously enables the use of a pivotal trigger on the front of the handle of the housing and a push button on the rear end of the head of the housing to respectively provide the water valve and soap pump operators displaceable by the fingers and thumb of a user.

In accordance with yet another aspect of the invention, the housing is internally structured for a considerable portion thereof in both the head and handle to provide a soap reservoir, thus optimizing the quantity of soap which can be stored in the sprayer and minimizing the refilling requirements with regard thereto. Preferably, a portion of the housing is provided with a transparent window enabling visual inspection of the quantity of soap in the sprayer, thus enabling replenishing of the soap supply prior to total consumption thereof.

It is accordingly an outstanding object of the present invention to provide an improved hand held and hand operated sprayer of the character having an inlet end for connection to a source of water under pressure and an outlet end for selectively dispensing a spray of water or a quantity of soap from a reservoir within the sprayer.

Another object is the provision of a sprayer of the foregoing character wherein the dispensing of water and soap can be achieved by one hand of a user and either selectively or simultaneously with minimal manipulation of the fingers of the user.

Another object is the provision of a sprayer of the foregoing character in which soap is adapted to be dispensed from the sprayer in a manner which precludes the backflow of water to the soap reservoir and thus the diluting and/or sudsing of soap in the reservoir.

A further object is the provision of a sprayer of the foregoing character wherein soap is dispensed by a pump and water is dispensed across a valve and wherein the pump and valve are structured and structurally interrelated so as to minimize the space requirements therefor and thus the size of a housing enclosing the parts.

Yet a further object is the provision of a sprayer of the foregoing character wherein the housing includes a head and a handle and is structured interiorly for portions of the head and handle to provide a soap reservoir.

Still another object is the provision of a sprayer of the foregoing character wherein the soap pump and water valve have corresponding actuators reciprocable along corresponding axes which are parallel to one another and extend in the direction between the front and rear ends of the housing, thus to minimize space requirements in the housing therefor while promoting operation of the water valve and pump by operating components on the front and rear ends of the housing.

Yet another object is the provision of a sprayer of the foregoing character in which the water valve and pump are respectively finger and thumb operated by one hand of a user through the manipulation of corresponding operating components on opposite sides of the housing.

Still a further object is the provision of a sprayer of the foregoing character wherein the portion of the housing providing the soap reservoir includes a transparent window for viewing the quantity of soap in the reservoir.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF THE PREFERRED EMBODIMENT

Figure 4:
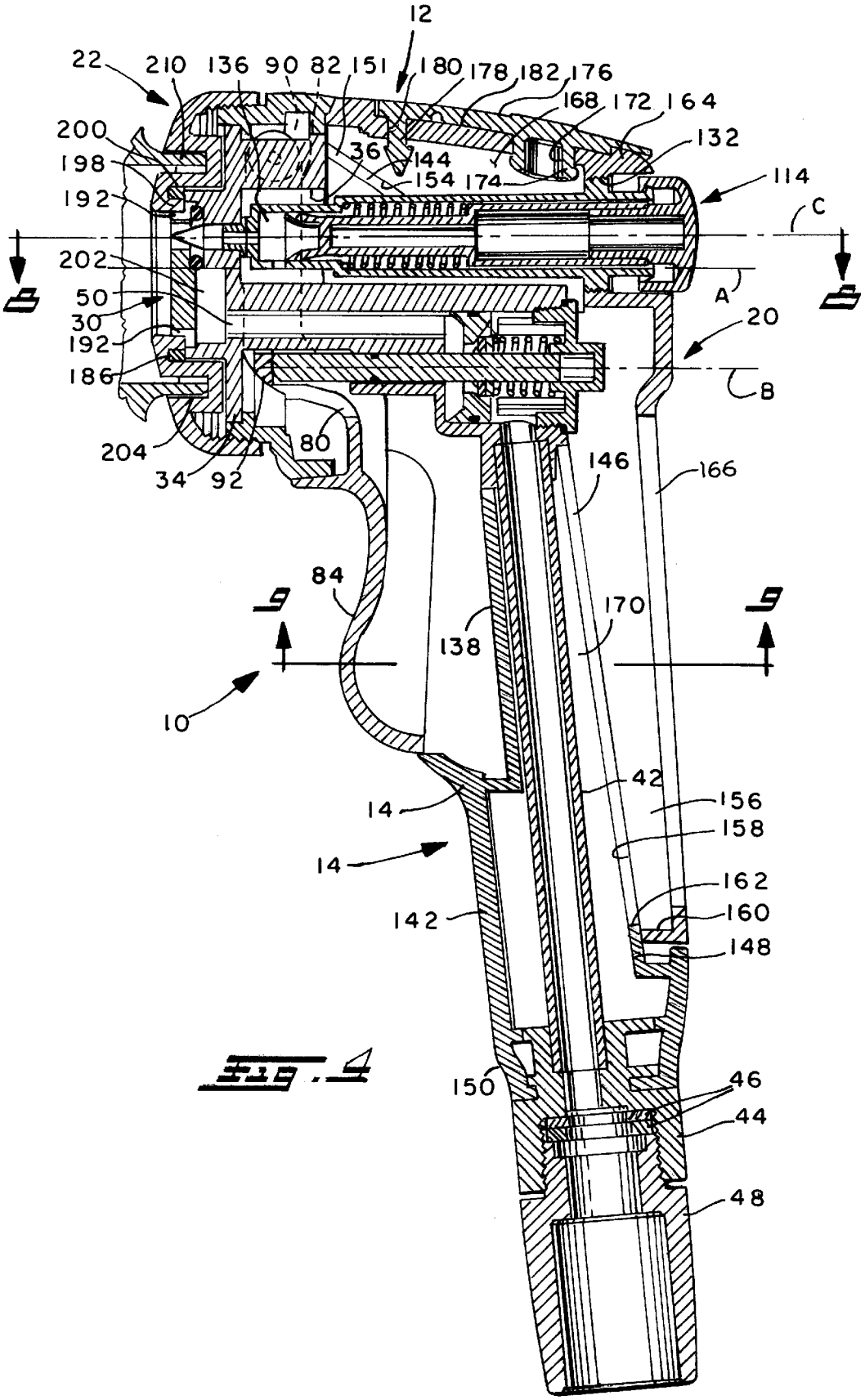
FIG. 4 is a sectional elevation view through the assembled sprayer showing the water valve closed and the soap pump at the end of its suction stroke.
Figure 5:
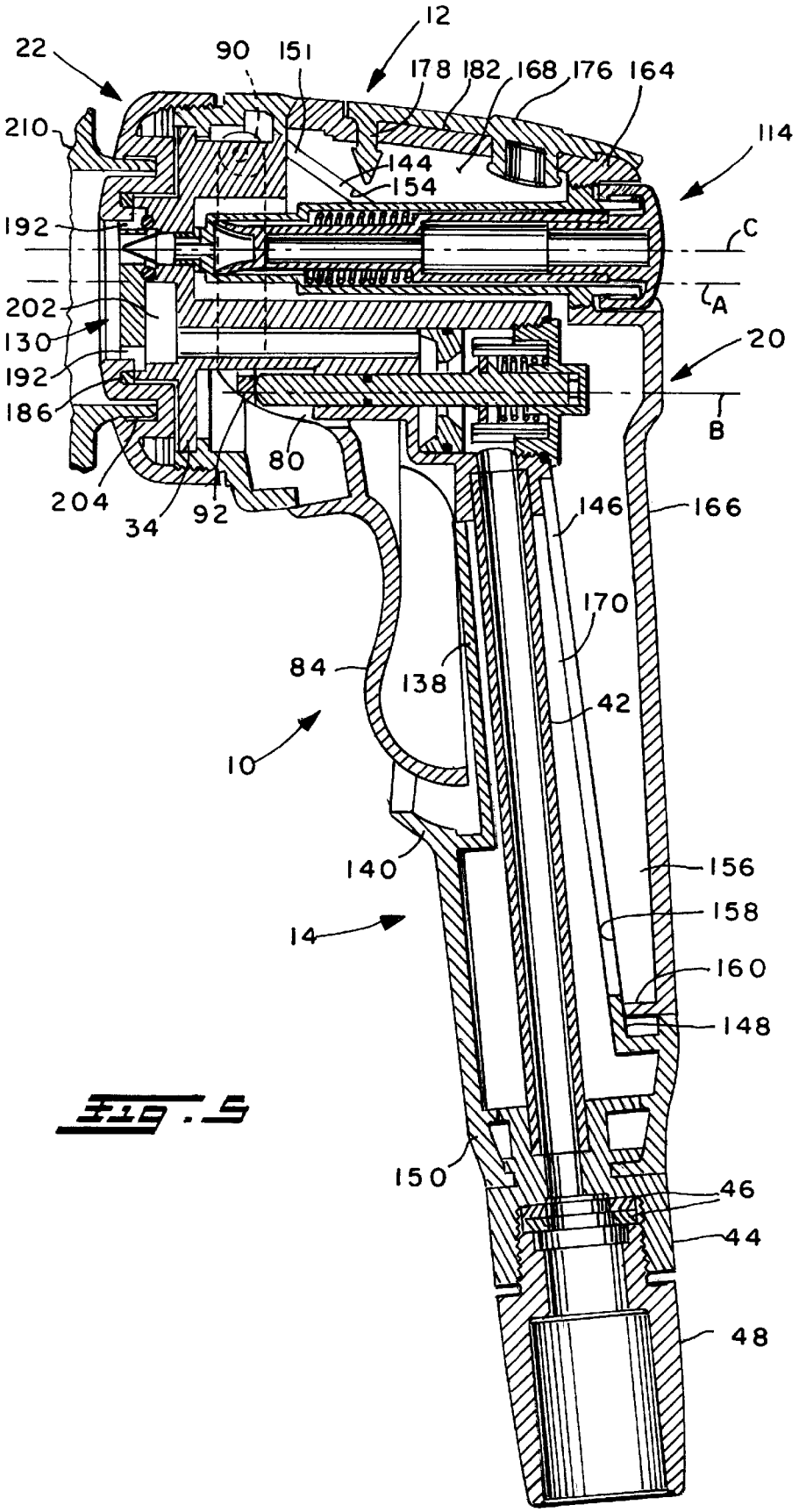
FIG. 5 is a sectional elevation view similar to FIG. 4 and showing the water valve open and the soap pump at the end of its discharge stroke.

Referring now in greater detail to the drawings wherein the showings are for the purpose of illustrating a preferred embodiment of the invention only and not for the purpose of limiting the invention, a hand held sprayer 10 in accordance with the present invention comprises a housing having a head 12 and a handle 14. The housing is comprised of opposite side portions 16 and 18, a rear cover 20 and a front cap 22. The housing, when assembled as described more fully hereinafter, encloses a water inlet and flow control assembly 24, a water flow control valve operator 26, a soap pump assembly 28 and a water spray and soap orifice plate 30. As best seen in FIGS. 4 and 5, head 12 of the housing has an axis A in the direction between the front and rear ends thereof, and handle 14 extends downwardly from the head at an angle to axis A.

Figures 1, 2:
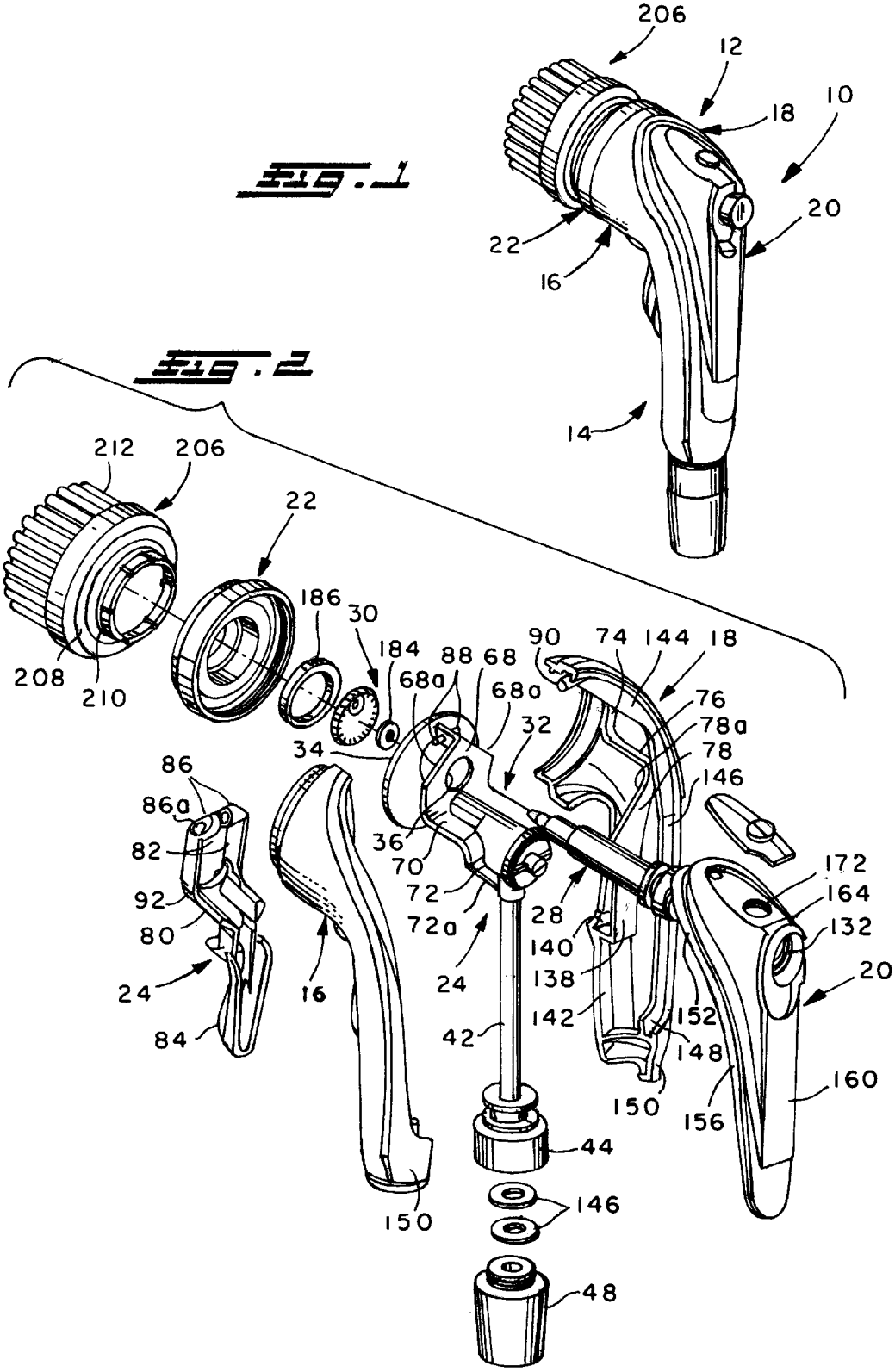
FIG. 1 is a perspective rear view of a hand held sprayer in accordance with the present invention.
FIG. 2 is an exploded perspective rear view of the sprayer.
Figure 3:
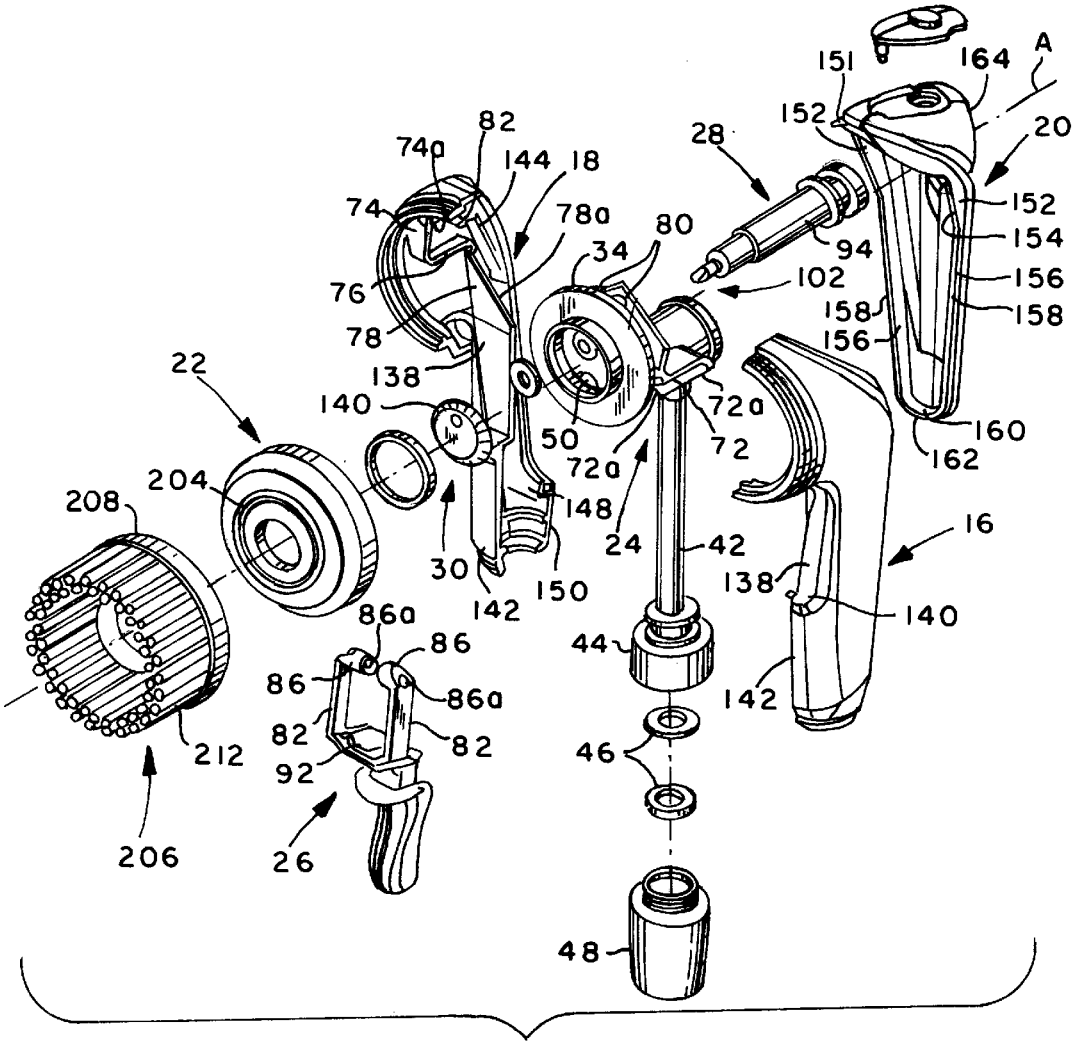
FIG. 3 is an exploded perspective front view of the sprayer.
Figure 6:
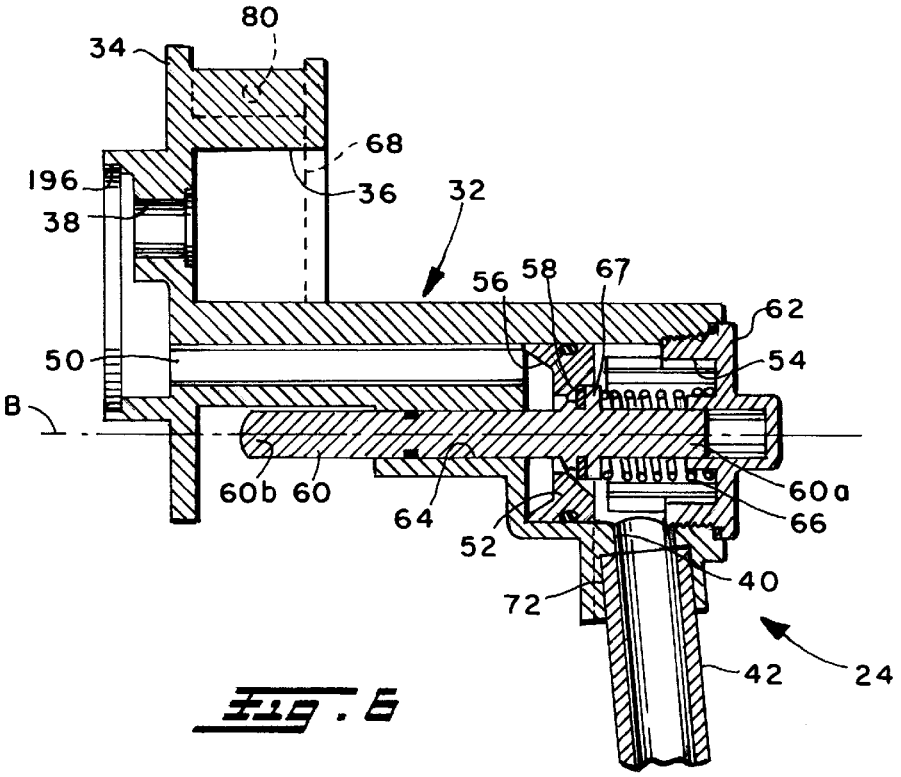
FIG. 6 is an enlarged sectional elevation view of the water inlet and flow control assembly.

As best seen in FIGS. 2, 3 and 6 of the drawings, water inlet and flow control valve assembly 24 includes a valve body 32 having a front portion including a circular mounting flange 34 and coaxial openings 36 and 38 for receiving the front end of soap pump assembly 28 as will become apparent hereinafter. Valve body 32 further includes a water flow path therethrough having an inlet end 40 adapted to be connected to a source of water under pressure by an inlet tube 42. An internally threaded plug 44 is mounted on the lower end of tube 42 for receiving washers 46 and a hose connector 48 by which the sprayer is connected to a water supply hose, not shown. The water flow path has an outlet end 50 at the front of valve body 32, and a water flow control valve is interposed in the flow path for controlling the flow of water between the inlet and outlet ends thereof. The flow control valve comprises a valve seat element 52 received in bore 54 of the valve body and having a valve seat 56 on the upstream side thereof with respect to the direction of flow of water thereacross, and a valve element comprising a valve head 58 of resilient material supported on an elongate valve actuator 60 having upstream and downstream ends 60*a* and 60*b*, respectively. Upstream end 60*a* is slidably received in a recess provided therefor in valve cap 62 which is threadedly and sealingly interengaged with the outer end of bore 54, and downstream end 60*b* is slidably supported in a bore 64 provided therefor in valve body 32. Valve actuator 60 has an actuator axis B parallel to and laterally spaced from axis A, and a valve spring 66 surrounds the valve actuator in bore 54 between the valve cap 62 and a backup flange 67 behind valve head 58. Spring 66 biases valve head 58 against valve seat 56 to close the valve against the flow of water thereacross. As will become apparent hereinafter, downstream end 60*b* of actuator 60 is adapted to be displaced in the upstream direction against the bias of spring 66 to move valve head 58 away from valve seat 56 so as to open the valve for the flow of water thereacross to outlet end 50 of the flow path.

As best seen in FIGS. 2 and 3 of the drawings, and for the purposes which will be described in greater detail hereinafter, valve body 32 includes an upwardly extending wall 68 spaced axially inwardly from mounting flange 34 and having inverted V-shaped upper edges 68*a*, walls 70 extending laterally outwardly from and axially along opposite sides of the valve body from the lower end of wall 68, and a downwardly extending wall 72 axially adjacent water inlet line 42 and having V-shaped edges 72*a*. The inner sides of housing portions 16 and 18 are provided with laterally inwardly extending walls 74, 76 and 78 which correspond respectively to wall 68, walls 70 and wall 72 on the valve body. Housing walls 74 and 78 have inner edges 74*a* and 78*a* corresponding respectively to edges 68*a* and 72*a* of walls 68 and 72 of the valve body, and when the housing portions are joined together the inner edges of all of the walls on the housing portions abut against the outer edges of the corresponding walls on the valve body.

Water valve operator 26 is a hand operable lever which, as best seen in FIGS. 2 and 3, has an axially extending central portion 80, a pair of mounting legs 82 extending upwardly from the forward end of central portion 80, and a trigger portion 84 extending downwardly from the inner end of the central portion. Legs 82 are laterally spaced apart to extend upwardly across the corresponding side of the portion of valve body 32 between flange 34 and wall 68, and the upper end of each leg 82 is provided with a laterally inwardly extending trunnion 86 by which the lever is pivotally mounted between the housing and valve body. More particularly in this respect, valve body 32 is provided with a pair of laterally outwardly extending pins 88 between flange 34 and wall 68, and the inner sides of housing portions 16 and 18 are provided with laterally inwardly extending circular studs 90 which are apertured to receive pins 88 when the housing is assembled. In connection with such assembly, the openings 86*a* in trunnions 86 receive studs 90, whereby valve operator 26 is pivotally supported by the studs. Valve operator 26 further includes an operator wall 92 at the forward end of central portion 80 and extending between the lower ends of legs 82 and, as will be appreciated from FIGS. 4 and 5 of the drawings, when trigger portion 84 is displaced counterclockwise relative to the lever pivot axis defined by studs 90, operator wall 92 engages against the outermost end of end 60*b* of valve actuator 60 to displace the latter in the direction to open the water valve.

Figure 7:
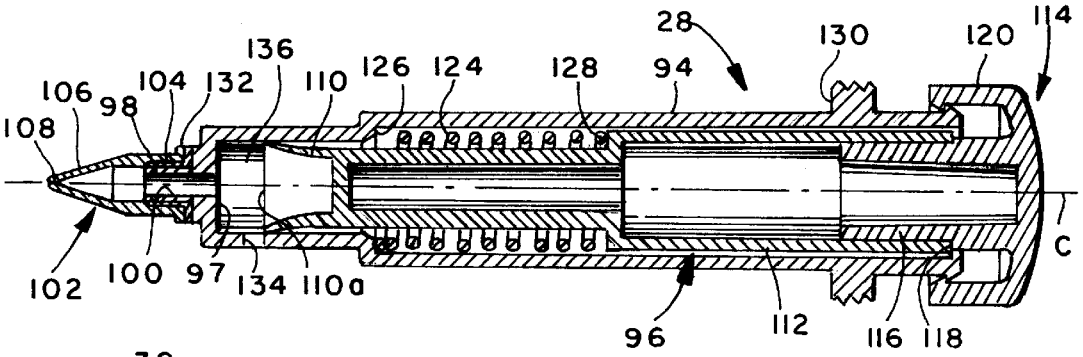
FIG. 7 is an enlarged sectional elevation view of the soap pump assembly.

As best seen in FIGS. 4, 5 and 7 of the drawings, soap pump assembly 28 comprises a cylinder 94 supporting a piston and piston actuator component 96 for sliding displacement in opposite directions along a piston actuator axis C which, as seen in FIGS. 4 and 5, is parallel to and laterally offset from both head axis A and valve actuator axis B. Cylinder 94 includes an outlet end defined by an apertured end wall 97 having a nipple 98 extending forwardly thereof and providing an outlet or discharge port 100. The pump outlet further includes a soap outlet flow control sleeve member 102 of rubber or the like having an inlet end 104 extending about nipple 98 and a constricted outlet end 106 having a slit 108 therein which functions in connection with the dispensing of soap as described more fully hereinafter and which is normally closed by the resiliency of the rubber material. The piston and piston actuator component 96 includes a piston 110 adjacent the outlet end of cylinder 94 and a piston actuator 112 extending rearwardly therefrom and having a push button pump operator component 144 interconnected with the outer end thereof. More particularly in this respect, push button component 114 includes a sleeve 116 extending into the axially outer end of actuator 112 and having a shoulder 118 engaging with the outer end thereof, and an annular skirt 120 extending axially across the axially outer end of cylinder 94 and having a radially inwardly extending shoulder 122 engaging against a radially outwardly extending shoulder on the cylinder, not designated numerically. A pump biasing spring 124 is provided in cylinder 94 about actuator 112 and between shoulders 126 and 128 respectively on the cylinder and actuator, and spring 124 biases the actuator and thus piston 110 to the right in FIG. 7 and to the position determined by the engagement of shoulder 122 with the shoulder on cylinder 94. Cylinder 94 is provided with an annular mounting flange 130 which is externally threaded for interengagement with an internally threaded aperture 132 in rear cover 20 of the sprayer housing. As will be appreciated from FIGS. 4 and 5, when the pump assembly is mounted in the housing, the outlet end of cylinder 94 and outlet member 102 thereon are respectively positioned in openings 36 and 38 in the front end of valve body 32. When so positioned, a radially outwardly extending circumferential flange 132 on the inlet end of member 102 sealingly engages against the inner end wall of opening 36 about opening 38 for the purpose which will become apparent hereinafter.

Piston and piston actuator component 96 is displaceable in cylinder 94 in opposite directions along axis C through suction and discharge strokes, and in FIG. 7 piston 110 is shown in the position thereof at the end of the suction stroke. The piston is manually displaced through the discharge stroke thereof against the bias of spring 124 by pushing inwardly on pump operator 114, and the discharge stroke is defined by engagement of leading end 110a of piston 110 with cylinder wall 97 at the outlet end of the cylinder. Upon release of operator 114, spring 124 returns the piston head to the position shown in FIG. 7 and, accordingly, displaces the latter through the suction stroke thereof As will be described in greater detail hereinafter, pump assembly 28 is disposed in a soap reservoir in the sprayer housing, and cylinder 94 is provided with a soap inlet port 134 which is forwardly adjacent edge 110*a* of the piston when the latter reaches the end of the suction stroke. As the piston moves across port 134 in moving toward the end of the suction stroke, soap is drawn into chamber 136 at the outlet end of cylinder 94, and when the piston moves forwardly through its discharge stroke, port 134 is closed and the soap in chamber 136 is positively displaced through soap outlet flow control member 102. More particularly in this respect, the pressure created by piston 110 forces the soap through slit 108 of flow control member 102 which expands against the resiliency of the rubber material thereof to allow the flow therethrough. When the piston begins to move rearwardly and through its suction stroke, a negative pressure is created in flow control member 102 and the negative pressure together with the resilient material of member 102 closes slit 108 and seals the latter against the ingress or backflow of fluid into chamber 136.

Referring again to FIGS. 2 and 3 together with FIGS. 4, 5, 8 and 9, the handle portion of each of the housing side portions 16 and 18 has an upper front wall 138 extending downwardly from the corresponding wall 78 described hereinabove, a wall 140 extending forwardly from the lower end of wall 138 and a lower front wall 142 extending downwardly from wall 140. The laterally inner edges of walls 138, 140 and 142 of the two housing portions are in abutting relationship when the housing portions are assembled. Further, each of the housing portions 16 and 18 includes a laterally inwardly extending flange having an upper portion 144 extending rearwardly and curving downwardly in the head area of the housing portion and a lower portion 146 extending downwardly in the handle area of the housing portion and terminating in a laterally inwardly extending portion 148 adjacent the lower end of the housing portion. The lower ends of each of the housing portions 16 and 18 are provided with a generally semi-circular portion 150 internally configured for mating interengagement with annular flanges, not designated numerically, on plug member 44.

Rear housing cover 20 includes a forwardly extending peripheral wall having an inverted U-shaped upper portion 151 including legs 152 on each of the laterally opposite sides of the cover. Portion 151 has forward edges 154 facially engaging upper portions 144 of the flanges on housing portions 16 and 18. The peripheral cover wall farther includes intermediate portions 156 having edges 158 facially engaging portions 146 of the flanges on housing portions 16 and 18, and a U-shaped lower portion 160 having an inner edge 162 facially engaging lower portions 148 of the flanges on the housing portions. Rear cover 20 of the housing further includes a shroud portion 164 which provides the internally threaded opening 132 and which includes a downwardly extending rear wall 166 of transparent material.

When housing portions 16 and 18 and rear housing cover 20 are assembled about water inlet and flow control assembly 24 and soap pump assembly 28, the abutting edges between the walls on the housing components and inlet and water flow control assembly 24, the abutting edges between housing walls 138, 140 and 142, the abutting edges between lower ends 150 of the housing portions and the flanges on member 44, and the abutting edges between the housing flanges and the peripheral wall of housing cover 20 are sonically bonded, adhesively bonded or otherwise joined together to provide a liquid-tight soap reservoir within the housing. The reservoir includes a portion 168 in head 12 which surrounds pump assembly 28 and is defined in part by the upper portion of shroud 164, and a portion 170 in handle 14 between front walls 138 and 142 thereof, the side walls of housing portions 16 and 18 extending rearwardly of the latter walls, the lower portion of shroud 164 and rear wall 166 of the rear cover. The top of shroud 164 is provided with a fill opening 172 opening into the upper end of the soap reservoir, and opening 172 is adapted to be closed by a plug 174 on the inner side of a cover 176 of suitable plastic material having a headed projection 178 received in a mounting opening 180 in shroud 164 for mounting cover 176 thereon. Cover 176 includes a slot 182 thereacross adjacent projection 176 to provide a live hinge by which the portion of the cover carrying plug 174 can be displaced relative to the mounted end of the cover to facilitate the pouring of soap into the reservoir. Wall 166 of transparent material provides a window through which the quantity of soap in the reservoir can be viewed.

Figure 10:
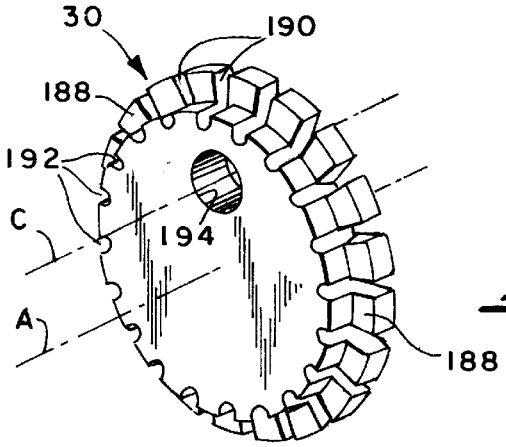
Figure 8:
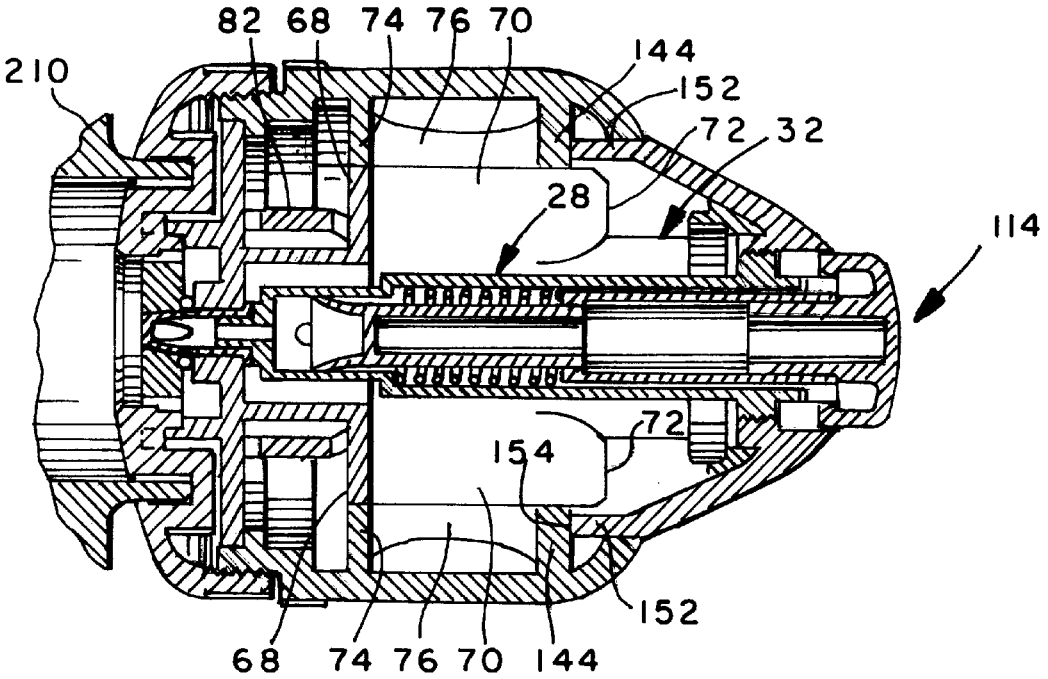
FIG. 8 is a plan view of the sprayer head, in section, looking in the direction of line 8—8 in FIG. 4.
Figure 9:
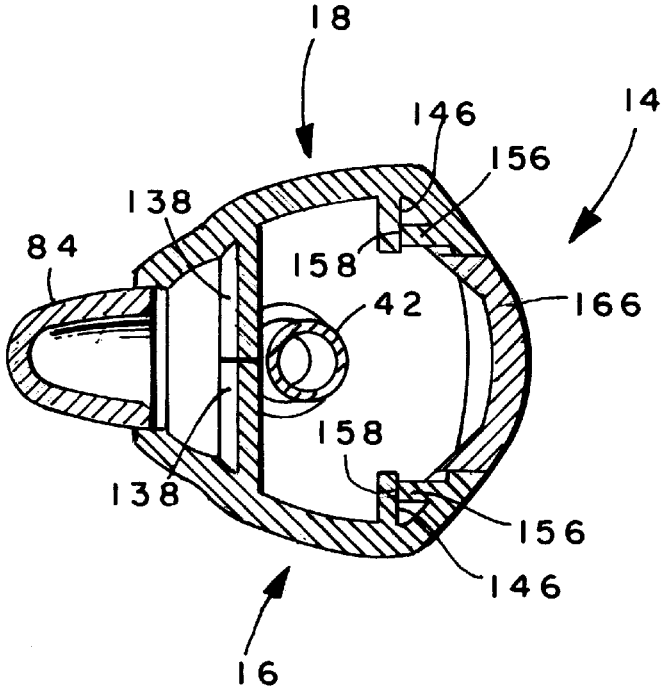
FIG. 9 is a cross-sectional view through the handle and trigger, looking in the direction of line 9—9 in FIG. 4; and, FIG. 10 is a perspective view of the water spray and soap orifice plate.

When the housing portions and rear cover have been assembled in the foregoing manner, front housing cap 22 is threaded onto the externally threaded front ends of housing portions 16 and 18 to releasably clamp water spray and soap orifice plate 30 in place together with annular seals 184 and 186 which respectively seal against the flow of water to the outlet end of the soap pump and radially outwardly of the orifice plate. The latter, as best seen in FIGS. 4 and 10, is circular and is axially stepped to provide a mounting shoulder 188 extending about the periphery thereof. The plate is provided with a plurality of radially inwardly extending slots 190 equally spaced apart about the periphery thereof and having inner ends 192 extending radially inwardly from the mounting shoulder. The plate further includes a soap orifice 194 coaxial with pump axis C. The inner side of the plate is adapted to seat in an annular recess 196 in the front end of valve body 32 with orifice 194 aligned with opening 38 therethrough, and the plate is adapted to be captured against recess 196 by an axially inwardly extending retaining flange 198 on the outer end of front cap 22 and which engages against mounting flange 88 of the plate. Seal 184 is interposed between the rear side of plate 30 and the surface of valve body 32 surrounding opening 38 therein, and seal 186 is engaged in aperipheral recess 200 surrounding cap flange 198 and is axially captured between the recess and the outer periphery of valve body 32.

As will be appreciated from FIG. 5 and the description of the water inlet and flow control assembly 24, water flowing across the flow control valve exits from outlet end 50 of the water flow path into a chamber 202 defined by the space between valve body 32 and plate 30 and is then discharged forwardly of the head in the form of a spray through inner ends 192 of recesses 190. In connection with such water flow, it will be appreciated that seal 184 precludes the passage of water radially inwardly from chamber 202 toward soap outlet member 102 and that seal 186 seals against the flow of water radially outwardly between the valve body, housing components and front cap 22.

Preferably, the front or outer end of front cap 22 is provided with an axially inwardly extending peripheral recess 204 for removably receiving a cleaning attachment such as the brush 206 shown in FIGS. 1–3. Such an attachment includes an annular base 208 having an axially inwardly extending annular flange 210 which is circumferentially interrupted and axially contoured for snaplock interengagement with recess 204 in the end cap. While the attachment is shown as a brush having bristles 212 mounted on and extending forwardly of base 208, it will be appreciated that the sprayer can be used without such an attachment and that attachments other than a brush can be used with the sprayer.

It is believed that operation of sprayer 10 will be readily understood from the drawings and the description thereof herein. Assuming the inlet end of water inlet tube 42 to be connected to a suitable source of water under pressure, such as a flexible hose associated with a sink, shower or the like, and assuming the reservoir to contain liquid soap and the component parts of the sprayer to be in the positions thereof shown in FIG. 4, the water flow control valve is closed and the pump piston is at the end of its suction stroke whereby pump chamber 136 is filled with soap. To use the sprayer, a user picks the latter up with one hand such that a finger or fingers extend across trigger portion 84 and the thumb is positioned against the outer end of pump operator 114. The user can then selectively dispense soap from the sprayer by pressing his or her thumb against pump operator 114, or dispense a spray of water by pulling back on trigger portion 84 with a finger or fingers to open the water valve. Alternatively, the user can simultaneously dispense both soap and water from the sprayer by simultaneously depressing the pump operator and pulling back on the trigger. Advantageously, as will be appreciated from FIGS. 4 and 5, soap is positively displaced through slit 108 of soap outlet member 102 during depression of pump operator 114 whereby, even if water is simultaneously discharged through spray orifices 192, water is precluded from backflow into the pump and reservoir areas by the positive forward flow of soap. Of particular advantage is the fact that when the user releases pump operator 114, the pump piston is displaced by spring 124 through its suction stroke creating a negative pressure in soap outlet member 102 which, together with the resiliency of the rubber material immediately closes slit 108, whereby the outlet member operates as a check valve to preclude the backflow of liquid into the pump and reservoir areas. When the user releases trigger 84 following the discharge of water, valve spring 66 biases valve actuator 60 and valve head 58 for the valve head to seat against valve seat 56 to close the valve and stop the discharge of water from the sprayer. As will be appreciated from FIG. 4, the closing force of spring 66 is supplemented by the pressure of water against the upstream side of the valve head. As will be further appreciated from FIGS. 4 and 5, the biasing of valve actuator 60 by spring 66 in response to the release of trigger 84 biases the valve operator clockwise about the lever pivot axis to return trigger 84 to its outer position relative to the front of handle 14 of the sprayer. While considerable emphasis has been placed on the structures and structural interrelationships between the component parts of a preferred embodiment of the hand operated sprayer and soap dispenser, it will be appreciated that other embodiments of the sprayer can be devised and that many changes can be made with respect to the preferred embodiment without departing from the principles of the invention. Accordingly, it is to be distinctly understood that the foregoing descriptive matter is to be interpreted merely as illustrative of the present invention and not as a limitation.

Having thus described the invention, it is claimed:

1. A hand held liquid sprayer comprising a housing having front and rear ends, an inlet for connection to a source of water under pressure, a water outlet for discharging water forwardly of said front end, a valve for enabling and disabling the flow of water from said inlet to said water outlet, a soap reservoir in said housing, a soap outlet for discharging soap forwardly of said front end, a soap pump for pumping soap from said reservoir through said soap outlet, a valve operator on one of said front and rear ends of said housing, and a pump operator on the other of said front and rear ends of said housing.

2. A sprayer according to claim 1, wherein said water outlet includes a plurality of openings for the discharge of a spray of water, and said soap outlet includes an orifice separate from said openings for the discharge of soap.

3. A sprayer according to claim 2, wherein said plurality of openings are in a circular array and said orifice is within said array.

4. A sprayer according to claim 1, wherein said valve operator is on said front end of said housing and said pump operator is on said rear end of said housing.

5. A sprayer according to claim 1, wherein said valve operator includes a pivotal lever and said pump operator includes a reciprocable plunger.

6. A hand held liquid sprayer comprising a housing having front and rear ends, an inlet for connection to a source of water under pressure, a water outlet for discharging water forwardly of said front end, a valve for enabling and disabling the flow of water from said inlet to said water outlet, a soap reservoir in said housing, a soap outlet for discharging soap forwardly of said front end, a soap pump for pumping soap from said reservoir through said soap outlet, a valve operator on one of said front and rear ends of said housing, and a pump operator on the other of said front and rear ends of said housing, said valve operator including a pivotal lever and said pump operator including a reciprocable plunger, said pivotal lever being on said front end of said housing, and said reciprocable plunger including an outer end on said rear end of said housing.

7. A sprayer according to claim 1, wherein said soap pump has suction and discharge strokes for respectively receiving soap from said reservoir and discharging received soap to said soap outlet.

8. A sprayer according to claim 7, wherein said pump includes a piston and said pump operator is attached thereto and manually displaceable for displacing said pump through said discharge stoke.

9. A sprayer according to claim 8, and a spring for displacing said pump through said suction stroke.

10. A hand held liquid sprayer comprising a housing having front and rear ends, an inlet for connection to a source of water under pressure, a water outlet for discharging water forwardly of said front end, a valve for enabling and disabling the flow of water from said inlet to said water outlet, a soap reservoir in said housing, a soap outlet for discharging soap forwardly of said front end, a soap pump for pumping soap from said reservoir through said soap outlet, a valve operator on one of said front and rear ends of said housing, and a pump operator on the other of said front and rear ends of said housing, said soap pump having suction and discharge strokes for respectively receiving soap from said reservoir and discharging received soap to said soap outlet, said pump including a piston and said pump operator being attached thereto and manually displaceable for displacing said pump through said discharge stoke, a spring for displacing said pump through said suction stroke, said soap outlet having an axis, and said piston and said pump operator being coaxial with said axis.

11. A sprayer according to claim 1, wherein said valve includes a valve seat and a reciprocable valve element having open and closed positions respectively spaced from and engaging said seat, said valve operator including a pivotal lever manually displaceable for displacing said valve element to said open position.

12. A sprayer according to claim 11, and a spring for displacing said valve element from the open to the closed position thereof.

13. A sprayer according to claim 12, wherein said water outlet has an axis and said valve seat and said valve element are coaxial with one another on a valve axis parallel to said axis of said water outlet.

14. A sprayer according to claim 1, wherein said housing includes a head having a head axis, said soap pump having a pump axis parallel to and laterally offset from said head axis and said valve including a valve seat having a valve axis and a reciprocable valve element coaxial with said valve axis, and said valve axis being parallel to said head axis and offset from said head axis and from said pump axis.

15. A hand held liquid sprayer comprising a housing having front and rear ends, an inlet for connection to a source of water under pressure, a water outlet for discharging water forwardly of said front end, a valve for enabling and disabling the flow of water from said inlet to said water outlet, a soap reservoir in said housing, a soap outlet for discharging soap forwardly of said front end, a soap pump for pumping soap from said reservoir through said soap outlet, a valve operator on one of said front and rear ends of said housing, and a pump operator on the other of said front and rear ends of said housing, said housing including a head having a head axis, said soap pump having a pump axis parallel to and laterally offset from said head axis and said valve including a valve seat having a valve axis and a reciprocable valve element coaxial with said valve axis, said valve axis being parallel to said head axis and offset from said head axis and from said pump axis, said pump including a piston coaxial with said pump axis and having suction and discharge strokes and said pump operator being attached to said piston and manually displaceable to displace said piston through said discharge stroke, said valve element having open and closed positions respectively spaced from and engaging said seat, and said valve operator including a pivotal lever manually displaceable to displace said valve element to the open position.

16. A sprayer according to claim 15, wherein said soap outlet is coaxial with said pump axis, a piston spring for displacing said piston through said suction stroke, and a valve spring biasing said valve element toward said closed position.

17. A sprayer according to claim 15, wherein said pump operator includes an operating end extending outwardly of said rear end of said housing and said pivotal lever extends outwardly from said front end of said housing.

18. A sprayer according to claim 17, wherein said soap reservoir in said housing includes a transparent wall for observing the quantity of soap in said reservoir.

19. A sprayer according to claim 17, wherein said water outlet includes a plurality of openings extending about and coaxial with said head axis and said soap outlet includes an orifice radially between said openings and said head axis.

20. A sprayer according to claim 19, wherein said soap outlet is coaxial with said pump axis, a piston spring for displacing said piston through said suction stroke, and a valve spring biasing said valve element toward said closed position.

21. A sprayer according to claim 20, wherein said soap reservoir in said housing includes a transparent wall for observing the quantity of soap in said reservoir.

22. A sprayer according to claim 14, wherein said rear end of said housing includes a transparent wall, said wall comprising a part of said soap reservoir.

23. A sprayer according to claim 1, wherein said soap pump includes a piston chamber and a piston having suction and discharge strokes therein, and said soap outlet includes a check valve for precluding flow of liquid from said soap outlet to said piston chamber during said suction stroke.

24. A sprayer according to claim 1, wherein said soap reservoir in said housing includes a transparent wall for observing the quantity of soap in said reservoir.

25. A sprayer according to claim 1, wherein said soap pump includes a piston chamber and a piston having suction and discharge strokes therein, and said soap outlet includes a check valve for precluding flow of liquid from said soap outlet to said piston chamber during said suction stroke.

26. A hand held sprayer comprising a housing including a head having front and rear ends and an axis in the direction between said ends, an inlet for connection to a source of water under pressure, a water outlet for discharging water forwardly of said head, a water valve having open and closed conditions with respect to the flow of water from said inlet to said water outlet, said valve including a valve actuator reciprocable along a valve actuator axis for displacing said valve between said open and closed conditions, a soap reservoir in said housing, a soap outlet for discharging soap forwardly of said head, a pump for pumping soap from said reservoir to said soap outlet, said pump including a pump actuator reciprocal along a pump actuator axis parallel to and laterally spaced apart from said valve actuator axis, each said valve and pump actuator axis being parallel to said head axis, a valve operator for displacing said valve actuator along said valve actuator axis, and a pump operator for displacing said pump actuator along said pump actuator axis.

27. A sprayer according to claim 26, wherein said housing includes a window of transparent material for viewing the quantity of soap in said reservoir.

28. A sprayer according to claim 26, wherein said housing includes a handle extending from said head at an angle to said head axis, said water valve and said pump being in said head.

29. A band held liquid sprayer comprising a housing having front and rear ends, an inlet for connection to a source of water under pressure, a water outlet for discharging water forwardly of said front end, a valve for enabling and disabling the flow of water from said inlet to said water outlet, a soap reservoir in said housing, a soap outlet for discharging soap forwardly of said front end, a soap pump for pumping soap from said reservoir through said soap outlet, a valve operator on one of said front and rear ends of said housing, and a pump operator on the other of said front and rear ends of said housing, said housing including a handle extending from said head at an angle to said head axis, said water valve and said pump being in said head, and said pump operator being at said rear end of said head.

30. A sprayer according to claim 28, wherein said handle has front and rear ends and said valve operator is at said front end of said handle.

31. A sprayer according to claim 30, wherein said pump operator is at said rear end of said head.

32. A sprayer according to claim 26, wherein said housing includes a handle and said reservoir includes a portion in said head and a portion in said handle.

33. A sprayer according to claim 32, wherein said handle includes a window of transparent material for viewing the soap in said reservoir.

34. A sprayer according to claim 26, wherein said soap pump has suction and discharges strokes and said soap outlet includes a check valve to preclude the flow of liquid rearwardly of said outlet during said suction stroke.

35. A hand held sprayer comprising a housing including a head having front and rear ends and an axis in the direction between said ends, an inlet for connection to a source of water under pressure, a water outlet for discharging water forwardly of said head, a water valve having open and closed conditions with respect to the flow of water from said inlet to said water outlet, said valve including a valve actuator reciprocable along a valve actuator axis for displacing said valve between said open and closed conditions, a soap reservoir in said housing, a soap outlet for discharging soap forwardly of said head, a pump for pumping soap from said reservoir to said soap outlet, said pump including a pump actuator reciprocal along a pump actuator axis parallel to and laterally spaced apart from said valve actuator axis, each said valve and pump actuator axis being parallel to said head axis, a valve operator for displacing said valve actuator along said valve actuator axis, and a pump operator for displacing said pump actuator along said pump actuator axis, said housing including a handle having front and rear ends and extending from said head at an angle to said head axis, said water valve and said pump being in said head, said pump operator being at said rear end of said head and coaxial with said pump actuator axis, and said valve operator being pivotally mounted on said housing and having a trigger portion at the front end of said handle and below said valve actuator axis.

36. A sprayer according to claim 35, wherein said soap reservoir includes a portion in said head and a portion in said handle, and said rear end of said handle includes a window of transparent material for viewing the quantity of soap in said reservoir.

37. A sprayer according to claim 36, wherein said head includes an opening for introducing soap into said reservoir, and a removable cover for closing said opening.

38. A sprayer according to claim 37, wherein said handle has an end spaced from said housing, said inlet being at said end of said handle.

39. A hand held sprayer comprising a housing including a head having front and rear ends and a head axis in the direction between said ends, a handle extending from said head at an angle to said axis and having an outer end spaced from said head and front and rear ends, a water inlet in said handle for connection to a source of water under pressure, a water outlet in said head for discharging water forwardly of said head, a water valve in said head comprising a valve seat having a valve axis parallel to said head axis, a valve element including a valve head reciprocal along said valve axis between seated and unseated positions relative to said seat for respectively closing and opening said valve with respect to the flow of water from said inlet to said water outlet, a valve operator on said front end of said handle and supported on said housing for displacing said valve element from said seated to said unseated position of said valve head, a soap reservoir in said housing, a soap outlet in said head for discharging soap forwardly of said head, a pump in said head, said pump comprising a cylinder and a piston reciprocable in said cylinder along a pump axis parallel to and spaced from said valve axis, said piston having suction and discharge strokes for respectively drawing soap into said cylinder and displacing soap in said cylinder to said soap outlet, and a pump operator at said rear end of said head for displacing said piston through said discharge stroke.

40. A sprayer according to claim 39, further including a first spring for biasing said valve element toward the seated position of said valve head, and a second spring for biasing said piston through said suction stroke thereof.

41. A sprayer according to claim 39, wherein said soap outlet includes a sleeve of resilient material having an inlet end for receiving soap from said pump and an outlet end constricted to a closed condition by the resilience of said material, whereby soap from said pump flows through said outlet end during said discharge stroke and said outlet end is closed during said suction stroke.

42. A sprayer according to claim 39, wherein said pump is in said soap reservoir and said cylinder has an opening thereinto from said reservoir for drawing soap into said cylinder during said suction stroke, said piston covering said opening in said cylinder during said discharge stroke.

43. A sprayer according to claim 42, wherein said cylinder has a discharge port and said soap outlet includes a sleeve of resilient material having an inlet end attached to said discharge port and an outlet end, said outlet end of said sleeve being constricted to a closed condition by the resiliency of the material thereof, whereby soap from said pump flows through said outlet end during said discharge stroke and said outlet end is closed during said suction stroke.

44. A sprayer according to claim 43, wherein said pump operator includes a push button at said rear end of said head, and a piston biasing spring between said piston and cylinder and biasing said piston through said suction stroke.

45. A sprayer according to claim 39, wherein said valve element includes an actuator rod carrying said valve head, said actuator rod being coaxial with said valve axis and having an end spaced from said valve head, said valve operator including a lever mounted on said housing for pivotal displacement about a lever axis in said head and transverse to said head axis, said lever including a trigger portion beneath said head for displacing said lever in one direction relative to said lever axis and an operating member between said lever axis and said trigger portion for engaging said end of said actuator rod and displacing said valve element from said seated to said unseated position of said valve head in response to displacement of said lever in said one direction.

46. A sprayer according to claim 45, wherein said valve seat has upstream and downstream sides with respect to the direction of flow of water thereacross from said water inlet to said water outlet, said valve head engaging said upstream side of said seat to close said valve, and a valve biasing spring for biasing said valve head toward the seated position thereof.

47. A sprayer according to claim 46, wherein said actuator rod extends through said valve seat and said valve head has upstream and downstream sides with respect to said direction of water flow, said downstream side of said valve head engaging said seat to close said valve, and said valve biasing spring engaging against said upstream side of said valve head.

48. A sprayer according to claim 47, wherein said water inlet is at said outer end of said handle, said pump axis is above said valve axis, and said lever pivot axis is above said pump axis.

49. A sprayer according to claim 45, wherein said pump is in said soap reservoir and said cylinder has an opening thereinto from said reservoir for drawing soap into said cylinder during said suction stroke, said piston covering said opening in said cylinder during said discharge stroke.

50. A sprayer according to claim 49, wherein said cylinder has a discharge port and said soap outlet includes a sleeve of resilient material having an inlet end attached to said discharge port and an outlet end, said outlet end of said sleeve being constricted to a closed condition by the resiliency of the material thereof, whereby soap from said pump flows through said outlet end during said discharge stroke and said outlet end is closed during said suction stroke.

51. A sprayer according to claim 50, wherein said pump operator includes a push button at said rear end of said head, a piston biasing spring between said piston and cylinder and biasing said piston through said suction stroke, said valve seat having upstream and downstream sides with respect to the direction of flow of water thereacross from said water inlet to said water outlet, said valve head engaging said upstream side of said seat to close said valve, and a valve biasing spring for biasing said valve head toward the seated position thereof.

52. A sprayer according to claim 51, wherein said soap reservoir includes a portion in said head and a portion in said handle, said handle including a window of transparent material for viewing the quantity of soap in said reservoir, said housing including a fill opening for said reservoir, and a removable cover for said fill opening.

53. A sprayer according to claim 52, wherein said actuator rod extends through said valve seat and said valve head has upstream and downstream sides with respect to said direction of water flow, said downstream side of said valve head engaging said seat to close said valve, said valve biasing spring engaging against said upstream side of said valve head, said water inlet being at said outer end of said handle, said pump axis being above said valve axis, and said lever pivot axis being above said pump axis.

54. A sprayer according to claim 39, wherein said soap reservoir includes a portion in said head and a portion in said handle, said handle including a window of transparent material for viewing the quantity of soap in said reservoir, said head including a fill opening for said reservoir, and a removable cover for said fill opening.

* * * * *